US005383772A

United States Patent [19]

Richardson, Jr. et al.

[11] Patent Number: 5,383,772

[45] Date of Patent: Jan. 24, 1995

[54] SCROLL COMPRESSOR STABILIZER RING

[75] Inventors: Hubert Richardson, Jr., Brooklyn; George W. Gatecliff, Saline, both of Mich.

[73] Assignee: Tecumseh Products Company, Tecumseh, Mich.

[21] Appl. No.: 147,687

[22] Filed: Nov. 4, 1993

[51] Int. Cl.[6] ..... F04C 18/04; F04C 27/00; F04C 29/02

[52] U.S. Cl. ..... 418/55.4; 418/55.5; 418/55.6; 418/57

[58] Field of Search ..... 418/55.4, 55.5, 55.6, 418/57

[56] References Cited

U.S. PATENT DOCUMENTS

| | | | |
|---|---|---|---|
| 2,841,089 | 7/1958 | Jones | 418/55.5 |
| 4,645,437 | 2/1987 | Sakashita et al. | 418/55.5 |
| 4,696,630 | 9/1987 | Sakata et al. | 418/55.5 |
| 4,861,245 | 8/1989 | Tojo et al. | 418/55.5 |
| 5,131,828 | 7/1992 | Richardson, Jr. et al. | 418/55.3 |
| 5,167,494 | 12/1992 | Inagaki et al. | 417/440 |
| 5,180,295 | 1/1993 | Swain et al. | 418/55.3 |
| 5,192,202 | 9/1993 | Lee | 418/55.5 |

FOREIGN PATENT DOCUMENTS

| | | | |
|---|---|---|---|
| 59-29790 | 2/1984 | Japan | 418/55.5 |
| 61-223288 | 10/1986 | Japan | 418/55.5 |
| 1-77779 | 3/1989 | Japan | 418/55.1 |
| 1-177480 | 7/1989 | Japan | 418/55.4 |
| 2-191888 | 7/1990 | Japan | 418/55.5 |
| 3-11180 | 1/1991 | Japan | 418/55.3 |
| 3-11182 | 1/1991 | Japan | 418/55.5 |
| 3-149382 | 6/1991 | Japan | 418/55.5 |
| 3160177 | 7/1991 | Japan | 418/55.5 |
| 4-91383 | 3/1992 | Japan | 418/55.3 |
| 4-132888 | 5/1992 | Japan | 418/55.3 |
| 4166690 | 6/1992 | Japan | 418/55.5 |

*Primary Examiner*—John J. Vrablik
*Attorney, Agent, or Firm*—Baker & Daniels

[57] ABSTRACT

A hermetic scroll-type compressor is disclosed including a housing, fixed and orbiting scroll members, a frame member having a thrust surface adjacent the orbiting scroll member back surface, and a crankshaft coupled to the orbiting scroll member. A non-sealing stabilizer ring device is disposed between the frame member and the orbiting scroll member to eliminate the small perturbation wobble remaining after the orbiting scroll member reacts with the oil pool thereby reducing scroll wear-in time. A stabilizer ring is mechanically or positively spring loaded by a wave spring washer to axially force the orbiting scroll member toward the fixed scroll.

30 Claims, 3 Drawing Sheets

SCROLL COMPRESSOR STABILIZER RING

BACKGROUND OF THE INVENTION

The present invention relates generally to a hermetic scroll-type compressor including intermeshing fixed and orbiting scroll members and, more particularly, to such a compressor having a stabilizer ring to reduce wobbling of the orbiting scroll member.

A typical scroll compressor comprises two facing scroll members, each having an involute wrap, wherein the respective wraps interfit to define a plurality of closed compression pockets. When one of the scroll members is orbited relative to the other, the pockets decrease in volume as they travel between a radially outer suction port and a radially inner discharge port, thereby conveying and compressing the refrigerant fluid.

It is generally believed that the scroll-type compressor could potentially offer quiet, efficient, and low-maintenance operation in a variety of refrigeration system applications. However, several design problems persist that have prevented the scroll compressor from achieving wide market acceptance and commercial success. For instance, during compressor operation, the pressure of compressed refrigerant at the interface between the scroll members tends to force the scroll members axially apart. Axial separation of the scroll members causes the closed pockets to leak at the interface between the wrap tips of one scroll member and the face surface of the opposite scroll member. Such leakage causes reduced compressor operating efficiency and, in extreme cases, can result in an inability of the compressor to operate.

Leakage at the tip-to-face interface between scroll members during compressor operation can also be caused by a tilting and/or wobbling motion of the orbiting scroll member. This tilting motion is the result of overturning moments generated by forces acting on the orbiting scroll at axially spaced locations thereof. Specifically, the drive force imparted by the crankshaft to the drive hub of the orbiting scroll is spaced axially from forces acting on the scroll wrap due to pressure, inertia, and friction. The overturning moment acting on the orbiting scroll member causes it to orbit in a slightly tilted condition so that the lower surface of the plate portion of the orbiting scroll is inclined upwardly in the direction of the orbiting motion. Wobbling motion of the orbiting scroll may result from the interaction between convex mating surfaces, particularly during the initial run-in period of the compressor. For instance, the mating wrap tip surface of one scroll member and face plate of the other scroll member may exhibit respective convex shapes due to machining variations and/or pressure and heat distortion during compressor operation. This creates a high contact point between the scroll members, about which the orbiting scroll has a tendency to wobble until the parts wear in. The wobbling perturbation occurs on top of the tilted orbiting motion described above.

Further, present scroll compressors of either low side or intermediate pressure designs separate oil out of the compressor before the oil impacts the scroll set (the set of the orbiting and fixed scroll members). Inadequate lubrication of the scrolls permits refrigerant leakage between the scroll wraps and thereby loss of compressor efficiency. Adequate lubrication of the scroll set is necessary during the run-in of the scrolls as well as during normal operation.

Efforts to counteract the separating force applied to the scroll members during compressor operation, and thereby minimize the aforementioned leakage, have resulted in the development of a variety of prior art axial compliance schemes. In a compressor in which the back side of the orbiting scroll member is exposed to suction pressure, it is known to axially preload the scroll members toward each other with a force sufficient to resist the dynamic separating force. However, this approach, with such a high preload force, results in high initial frictional forces between the scroll members and/or bearings when the compressor is at rest, thereby causing difficulty during compressor startup and a subsequent increased power consumption. Another approach is to assure close manufacturing tolerances for component parts and have the separating force borne by a thrust bearing or surface. This requires an expensive thrust bearing, and involves high manufacturing costs in maintaining close machining tolerances.

The present invention is directed to overcoming the aforementioned problems associated with scroll-type compressors, wherein it is desired to provide a stabilizer ring assembly to reduce wobbling of the orbiting scroll member and reduce run-in time of the scroll set.

SUMMARY OF THE INVENTION

The present invention overcomes the disadvantages of the above-described prior art scroll-type compressors by providing a stabilizer ring assembly between the orbiting scroll member and an associated thrust bearing to axially bias the orbiting scroll member toward the fixed scroll.

Generally, the invention provides a scroll-type compressor including a fixed scroll member and an orbiting scroll member that are biased toward one another by an axial compliance mechanism. The drive mechanism by which the orbiting scroll member is orbited relative to the fixed scroll member has a tendency to cause a tilting and wobbling motion of the orbiting scroll member during compressor operation. An oil pool is provided adjacent the radially outer portion of the back surface of the orbiting scroll member, whereby a reactionary force is exerted by the oil upon the back surface in response to the rotating inclined and wobbling motion of the orbiting scroll member.

More specifically, the invention provides a non-sealing stabilizer ring disposed between the orbiting scroll member and the main bearing. A biasing means, such as a wave washer, engages the stabilizer ring to give the orbiting scroll member a small axial force upward (i.e. toward the fixed scroll member) to reduce orbiting scroll wobble. The stabilizer ring has a number of openings or passageways to permit oil to flow past the ring without restriction.

An advantage of the scroll-type compressor of the present invention is that wobbling motion of the orbiting scroll member is effectively minimized without substantially increasing the constantly applied axial compliance force, thereby improving sealing properties while minimizing power consumption.

An advantage of the scroll-type compressor of the present invention is the provision of an axial compliance mechanism that resists axial separation of the scroll members caused by both separating forces and overturning moments applied to the orbiting scroll member.

Yet another advantage of the scroll-type compressor of the present invention is the provision of a mechanism for counter-acting the rotating inclined wobbling motion of the orbiting scroll member that functions independently of static pressure levels utilized for counter-acting the separating forces between the scroll members.

A further advantage of the scroll-type compressor of the present invention is that a controlled quantity of oil is used to control leakage while the compressor is running.

Another advantage of the scroll-type compressor of the present invention is that scroll run-in time is reduced by the oil flow through the scroll wraps.

Another advantage of the scroll-type compressor of the present invention is that the stabilizer ring disclosed eliminates the need for a check valve in the discharge port that normally prevents scroll auto-rotation during compressor shutdown.

A still further advantage of the scroll compressor of the present invention is the provision of a simple, reliable, inexpensive, and easily manufactured compliance mechanism for producing a constantly applied force on the orbiting scroll plate toward the fixed scroll member, and for producing a reactionary force in response to wobbling/tilting motion of the orbiting scroll member.

The invention, in one form thereof, provides a scroll compressor including a hermetically sealed housing having a discharge chamber at discharge pressure and a suction chamber at suction pressure. A fixed scroll member is disposed within the housing having an involute fixed wrap element which is intermeshed with another fixed wrap element on an orbiting scroll member. The frame or main bearing includes a thrust surface adjacent the orbiting scroll back surface, with a seal disposed between the orbiting scroll and thrust surface to sealingly separate back portions of the orbiting scroll member. The compressor includes a drive means for causing the orbiting scroll member to orbit relative to the fixed scroll member thereby compressing fluid. An annular stabilizer ring device is nonsealingly disposed between the orbiting scroll member and the thrust surface so that the stabilizer ring device positively, axially biases the orbiting scroll member toward the fixed scroll member so that any wobbling of the orbiting scroll member is reduced.

In one form of the invention, the stabilizer ring device includes a wave spring washer to provide the axial biasing force to the orbiting scroll member.

Figure 1:
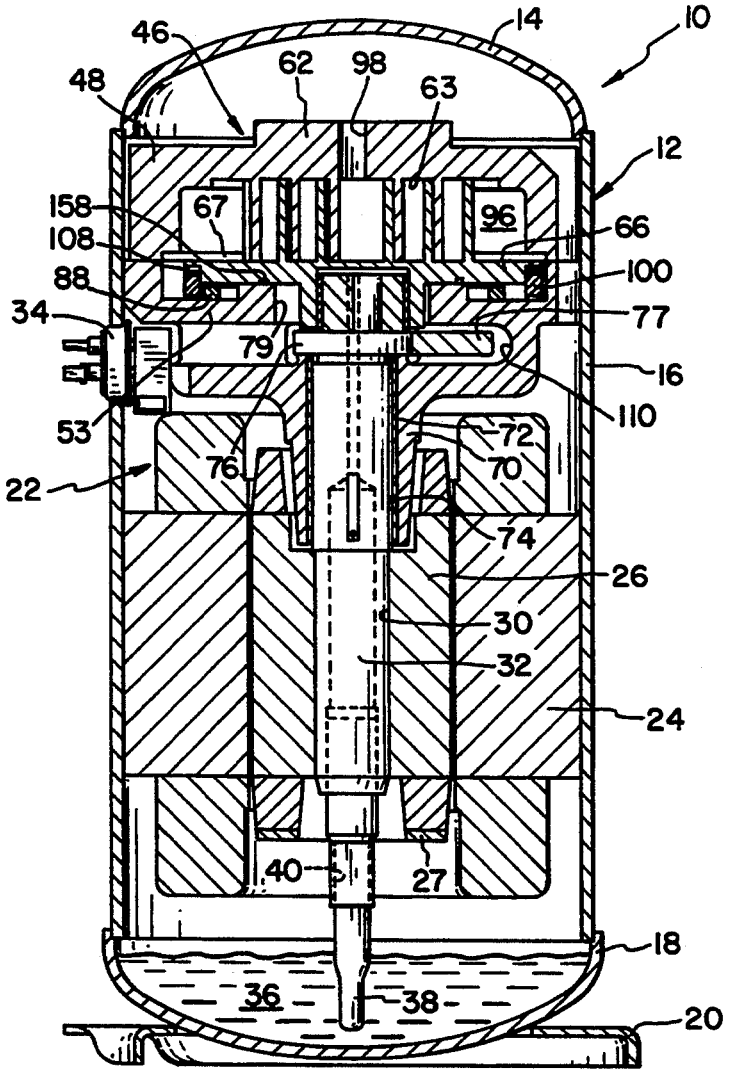
FIG. 1 is a longitudinal sectional view of a compressor of the type to which the present invention pertains.

Corresponding reference characters indicate corresponding parts throughout the several views. The exemplifications set out herein illustrate a preferred embodiment of the invention, in one form thereof, and such exemplifications are not to be construed as limiting the scope of the invention in any manner.

DESCRIPTION OF THE PREFERRED EMBODIMENT

Figure 2:
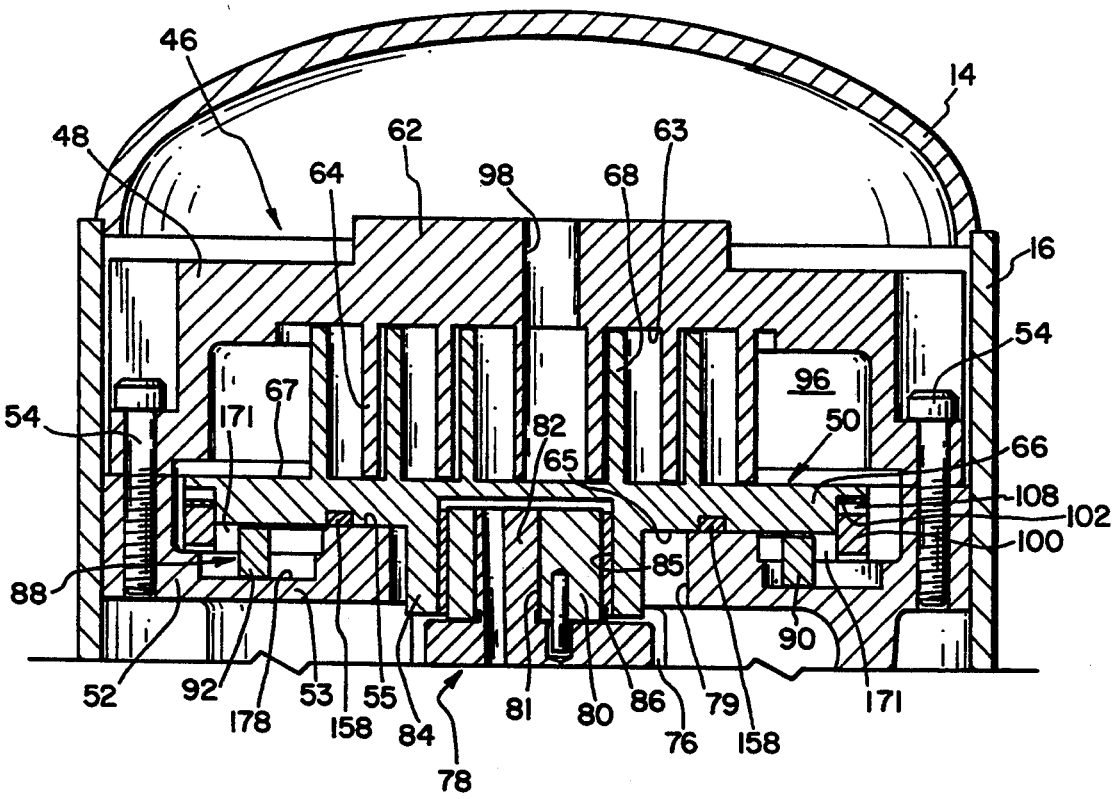
FIG. 2 is an enlarged fragmentary sectional view of the compressor of FIG. 1.

In an exemplary embodiment of the invention as shown in the drawings, and in particular by referring to FIGS. 1 and 2, a compressor 10 is shown having a housing generally designated at 12. This embodiment is only provided as an example and the invention is not limited thereto. The housing has a top cover portion 14, a central portion 16, and a bottom portion 18, wherein central portion 16 and bottom portion 18 may alternatively comprise a unitary shell member. The three housing portions are hermetically secured together as by welding or brazing. A mounting flange 20 is welded to bottom portion 18 for mounting the compressor in a vertically upright position. Located within hermetically sealed housing 12 is an electric motor generally designated at 22, having a stator 24 and a rotor 26. Stator 24 is secured within central portion 16 of the housing by an interference fit such as by shrink fitting, and is provided with windings 28. Rotor 26 has a central aperture 30 provided therein into which is secured a crankshaft 32 by an interference fit. The rotor also includes a counterweight 27 at the lower end ring thereof. A terminal cluster 34 is provided in central portion 16 of housing 12 for connecting motor 22 to a source of electric power.

Compressor 10 also includes an oil sump 36 generally located in bottom portion 18. A centrifugal oil pickup tube 38 is press fit into a counterbore 40 in the lower end of crankshaft 32. Oil pickup tube 38 is of conventional construction and includes a vertical paddle (not shown) enclosed therein.

Compressor 10 includes a scroll compressor mechanism 46 enclosed within housing 12. Compressor mechanism 46 generally comprises a fixed scroll member 48, an orbiting scroll member 50, and a main bearing frame member 52. As shown in FIG. 2, fixed scroll member 48 and frame member 52 are secured together by means of a plurality of mounting bolts 54.

Fixed scroll member 48 comprises a generally flat face plate 62 having a face surface 63, and an involute fixed wrap 64 extending axially from surface 63. Likewise, orbiting scroll member 50 comprises a generally flat face plate 66 having a back surface 65, a top face surface 67, and an involute orbiting wrap 68 extending axially from surface 67. Fixed scroll member 48 and orbiting scroll member 50 are assembled together so that fixed wrap 64 and orbiting wrap 68 operatively interfit with each other. Furthermore, face surfaces 63, 67 and wraps 64,68 are manufactured or machined such that, during compressor operation when the fixed and orbiting scroll members are forced axially toward one another, the tips of wraps 64, 68 sealingly engage with respective opposite face surfaces 67, 63.

Main bearing frame member 52 includes an annular, radially inwardly projecting portion 53, including an axially facing stationary thrust surface 55 adjacent back surface 65 and in opposing relationship thereto. Back surface 65 and thrust surface 55 lie in substantially parallel planes and are axially spaced according to machining tolerances and the amount of permitted axial compliance movement of orbiting scroll member 50 toward fixed scroll member 48.

Main bearing frame member 52, as shown in FIG. 1, further comprises a downwardly extending bearing portion 70. Retained within bearing portion 70, as by press fitting, is a conventional sleeve bearing assembly comprising an upper bearing 72 and a lower bearing 74. Two sleeve bearings are preferred rather than a single longer sleeve bearing to facilitate easy assembly into bearing portion 70 and to provide an annular space between the two bearings 72, 74. Accordingly, crankshaft 32 is rotatably journalled within bearings 72, 74.

Crankshaft 32 includes a concentric thrust plate 76 extending radially outwardly from the sidewall of crankshaft 32. A balance weight 77 is attached to thrust plate 76, as by bolts.

An eccentric crank mechanism 78 is situated on the top of crankshaft 32, as best shown in FIG. 2. According to a preferred embodiment, crank mechanism 78 comprises a cylindrical roller 80 having an axial bore 81 extending therethrough at an off-center location. An eccentric crankpin 82, constituting the upper, offset portion of crankshaft 32, is received within bore 81, whereby roller 80 is eccentrically journalled about eccentric crankpin 82. Orbiting scroll member 50 includes a lower hub portion 84 that defines a cylindrical well 85 into which roller 80 is received. Roller 80 is journalled for rotation within well 85 by means of a sleeve bearing 86, which is press fit into well 85. Each of sleeve bearings 72, 74, and 86 is preferably a steel-backed bronze bushing.

When crankshaft 32 is rotated by motor 22, the operation of eccentric crankpin 82 and roller 80 within well 85 causes orbiting scroll member 50 to orbit with respect to fixed scroll member 48. Roller 80 pivots slightly about crankpin 82 so that crank mechanism 78 functions as a conventional swing-link radial compliance mechanism to promote sealing engagement between fixed wrap 64 and orbiting wrap 68. This mechanism also controls the amount of lubrication between scroll members 48 and 50. Orbiting scroll member 50 is prevented from rotating about its own axis by means of a conventional Oldham ring assembly, comprising an Oldham ring 88, and Oldham key pairs 90,92 associated with orbiting scroll member 50 and frame member 52, respectively.

Figure 3:
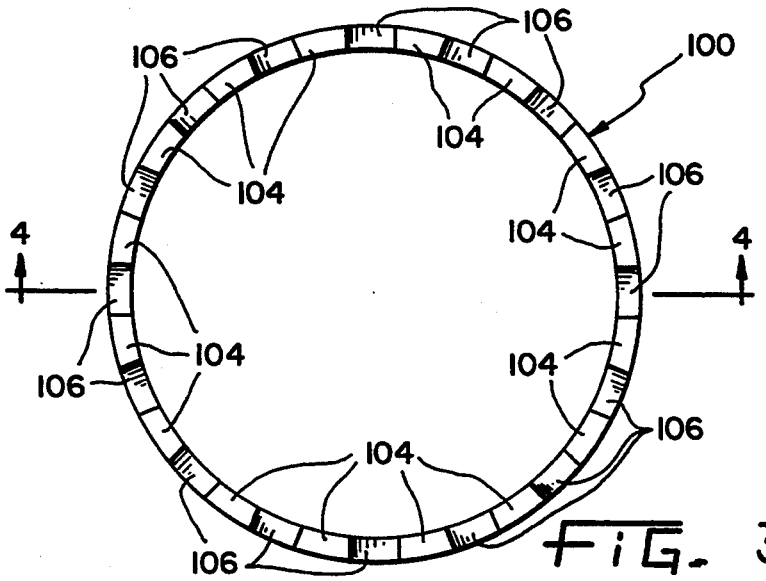
FIG. 3 is a top view of the stabilizer ring of the present invention.
Figure 4:
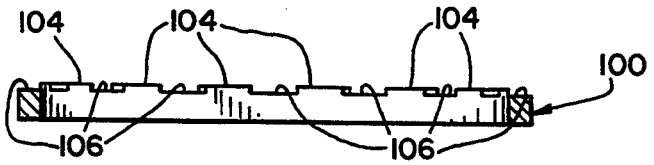
FIG. 4 is a sectional view of the stabilizer ring of FIG. 3, taken along the line 4—4 in FIG. 3 and viewed in the direction of the arrows.

The present invention of the stabilizer ring device 94 comprises a stabilizer ring 100 as shown in FIGS. 3 and 4, disposed within a counter bore, forming a shoulder 102, on the bottom surface 65 of orbiting scroll member 50. As shown in FIGS. 3 and 4, stabilizer ring 100 has a number of axial protrusions 104 which create radial passageways 106 for passage of oil. The number of axial protrusions may be varied in shape and size to assure even loading of stabilizer ring 100. Radial passageways 106 permit the operation of stabilizer ring 100 in a non-sealing fashion so that oil located beneath orbiting scroll 50 may flow past stabilizer ring 100 and into contact with surface 67 of orbiting scroll member 50.

The engagement of stabilizer ring device 94 between orbiting scroll 50 and thrust bearing 52 may comprise different embodiments. The preferred embodiment is that shown in FIG. 2 in which ring device 94 is located radially outside of seal 158, along the circumference of orbiting scroll member 50. The ring device may be mounted to orbiting scroll member 50 to ride along main bearing or vise versa. The mounting may be such that the tolerance size between the outside diameter of orbiting scroll member 50 and the inside diameter of portions of ring device 94 are so close that the ring device 94 may simply be pushed onto orbiting scroll member 50 and cling there with a slight interference fit. Alternatively, the ring device 94 may be manufactured to tolerances such that it clings to the orbiting scroll member 50 during assembly but disengages during compressor operation.

Figure 6:
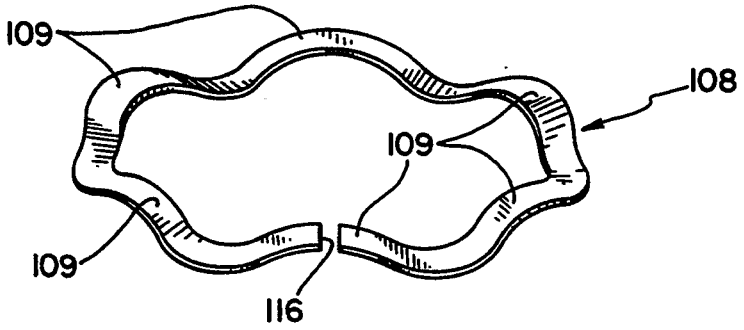
FIG. 6 is a perspective view of the wave washer of FIG. 5.

As shown in FIG. 2, disposed between orbiting scroll 50 and stabilizer ring 100 in shoulder bore 102 is a standard wave washer type spring 108 such as a wave washer spring Ser. No. 9960-08 from Smalley Steel Ring Company, Wheeling, Ill. It has been found through experiment that a wave washer 108 with approximately six (6) waves 109 as shown in FIG. 6 yields the best results. However, other types and sizes of wave washers may be utilized. Wave spring washer 108 mechanically or positively biases the orbiting scroll member 50 toward the fixed scroll member 48.

Wave spring washer 108, together with the geometry of the orbiting scroll member 50, preferably creates approximately an 80 pound load of orbiting scroll 50 against fixed scroll member 48. In other forms of the invention, the wave spring washer 108 can provide a force of approximately 60 to 100 pounds of force. Variations of the axial force needed for stabilization will depend on specific sizes and embodiments of orbiting scroll member 50.

Figure 5:
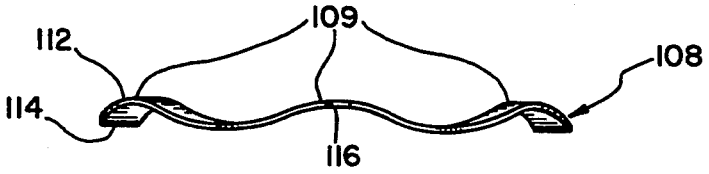
FIG. 5 is an elevational view of the wave washer of the present invention.

The spring force in wave washer 108 is created between the top 112 of one wave to the bottom 114 of another, as shown in FIG. 5 by the natural properties of wave washer 108. The spring force of wave washer 108 is used to form the biasing axial force of stabilizer ring device 94.

Preferably, wave washer 108 is manufactured from carbon spring steel, but other materials may alternatively be used. Although the geometry of wave washer 108 permits oil to flow past it by the necessary radial passages above and below the waves 109, additionally there is constructed a free gap 116 in the wave washer circumference to increase the oil flow past wave washer 108.

Figure 7:
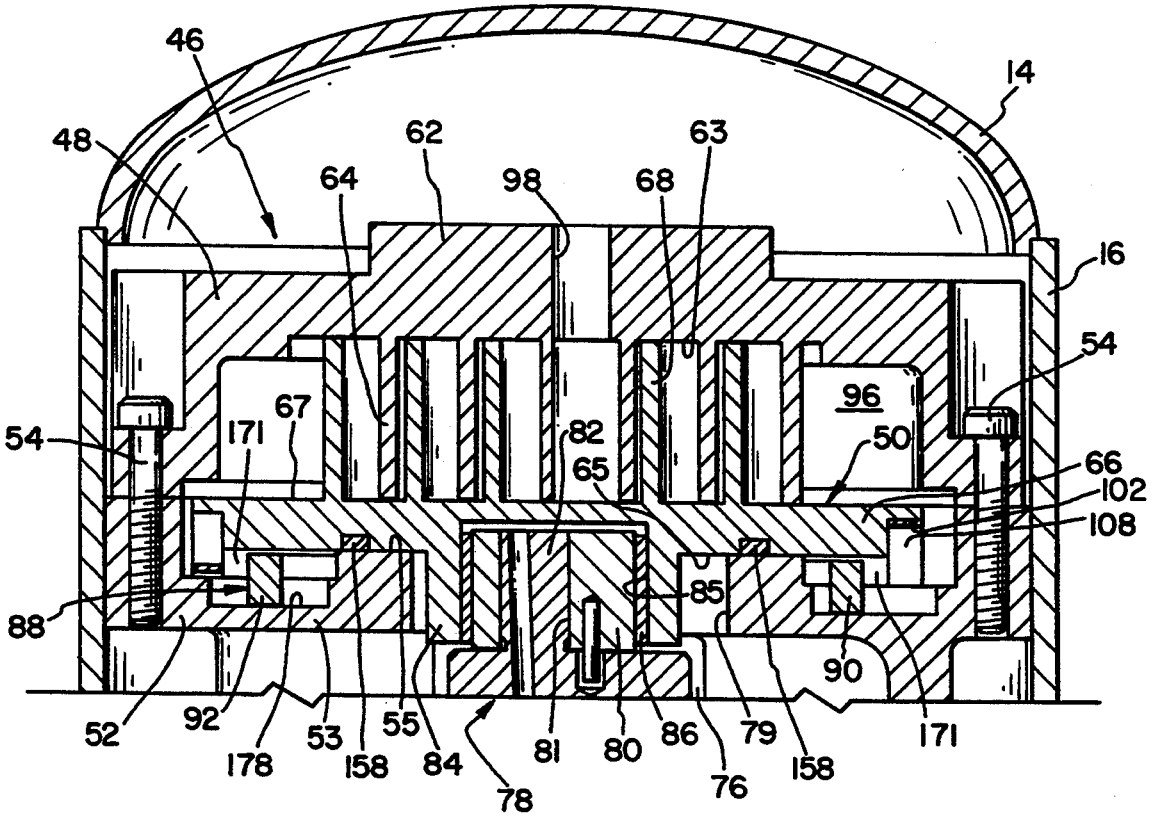
FIG. 7 is a view of an alternate embodiment of the invention.

Depending on the particular geometry of the main bearing 52 and orbiting scroll member 50, the height of stabilizer ring 100 will change. The purpose of stabilizer ring 100 is to place the wave washer 108 as close to the orbiting scroll member 50 as possible to assure that wave washer 108 is capable of handling any wobbling of the orbiting scroll member 50 and further reduce the deformation of wave washer 108 necessary for proper compressor function. The stabilizer ring 100 limits the amount of deformation of wave washer 108. Alternatively, some geometries of orbiting scroll member and main bearing construction do not need a stabilizer ring 100 but only a wave washer 108 as shown in FIG. 7. Equivalently, the reverse may be true, i.e., that only a stabilizer ring 200 may be needed for support of orbiting scroll 50.

In operation of compressor 10 of the preferred embodiment, refrigerant fluid at suction pressure is introduced through a suction tube (not shown), which is sealingly received within a counterbore in fixed scroll member 48 with the aid of an O-ring seal. Suction tube is secured to the compressor by means of a suction tube adaptor that is silver soldered, welded or brazed at respective ends to the suction tube an opening in the housing. A suction pressure chamber 96 is generally defined by fixed scroll member 48 and frame member 52. Refrigerant is introduced into chamber 96 from suction tube at a radially outer location thereof. As orbiting scroll member 50 is caused to orbit, refrigerant fluid within suction pressure chamber 96 is compressed radially inwardly by moving closed pockets defined by fixed wrap 64 and orbiting wrap 68.

Refrigerant fluid at discharge pressure in the innermost pocket between the wraps is discharged upwardly through a discharge port 98 communicating through face plate 62 of fixed scroll member 48 into housing 12. A discharge tube (not shown) extends through central portion 16 of housing and is sealed thereat as by silver solder, brazing, or welding. The discharge tube allows pressurized refrigerant within housing 12 to be delivered to the refrigeration system (not shown) in which compressor 10 is incorporated.

Compressor 10 also includes a lubrication system for lubricating the moving parts of the compressor, including the scroll members, crankshaft, and crank mechanism.

A thorough description of the lubrication system and compressor system operation is shown and described in assignee's U.S. Pat. No. 5,131,828, which is incorporated herein by reference.

Referring now to FIG. 2, lubricating oil is provided by the aforementioned lubrication system to the central portion of the underside of orbiting scroll member 50 within well 85. Accordingly, when the lubricating oil fills chamber 178, an upward force acts upon orbiting scroll member 50 toward fixed scroll member 48. The magnitude of this upward force, determined by the surface area of the bottom surface of orbiting scroll 50 is insufficient to provide the necessary axial compliance force. Therefore, in order to increase the upward force on orbiting scroll member 50, an annular portion of back surface 65 immediately adjacent, i.e., circumjacent, hub portion 84 is exposed to refrigerant fluid at discharge pressure. Additionally, the stabilizer ring device 94 includes wave washer 108 providing a small axial force to be described later.

Stabilizer spring device 94 of the present invention provides a small but necessary axial force to precisely even out the slight tilting and wobbling of orbiting scroll member 50 even though it is operating above oil pool 171. During operation, oil will be disposed beneath and slightly above orbiting scroll plate 66. As compressor 10 operates, a small amount of oil will shoot up into the space between orbiting scroll base plate 66 and the edge of main bearing 52 and/or the edge of fixed scroll member 48. This small amount of oil will shoot up into the space between the orbiting scroll member 50 and fixed scroll member 46 and potentially cause the orbiting scroll member 50 to tilt. By the incorporation of the present invention of stabilizer ring device 94, the very small axial force of wave washer 108 permits scroll member 48 and 50 to maintain complete contact, due to the large moment arm achieved by locating the ring at the outermost periphery of the orbiting scroll back plate. It is this complete contact that permits the substantial reduction of wear-in time of the present invention.

Wave washer 108 accomplishes this task by having a plurality of waves 109 in contact with the back of orbiting scroll member 50 and stabilizer ring 100. Stabilizer ring 100 is in contact with main bearing 52, acting as a bridge between main bearing 52 and wave washer 108. Each wave 109 acts as a individual spring, at its point of contact, to force orbiting scroll in an axial direction relative main bearing 52. By having waves 109 spread out behind orbiting scroll member 50, a leveling effect is created that balances any tilting or tipping of the orbiting scroll member 50. Stabilizer ring 100 assures that wave washer 108 neither loses contact with orbiting scroll member 50 nor becomes overcompressed.

An important aspect of the stabilizer ring device of the present invention is that it alleviates the necessity of a check valve that is common in the art of scroll type compressors. Normally a one way check valve is utilized on discharge port 98 to prevent reverse rotation of orbiting scroll member 50 during compressor shutdown. This reverse rotation is caused by unequal pressure areas within the compressor.

Stabilizer ring device 94 prevents reverse rotation during compressor shutdown by causing the scrolls to radially separate instead of axially separate when power is removed from motor 22. This separation equalizes pressure throughout the compressor thereby reducing or eliminating reverse rotation of orbiting scroll 50.

Radial separation of the scrolls at compressor shutdown is caused by a drag force created by stabilizer ring device 94 on orbiting scroll member 50. This drag force caused by the stabilizer ring device 94 moving through a pool 171 of essentially stationary oil prevents the orbiting scroll member 50 from sealing with the fixed scroll member 46 while at the same time slowing any movement of orbiting scroll member 50. By preventing reverse rotation during shutdown, the loud cranking and gurgling noises of compressor shutdown are eliminated.

The oil control mechanism of the present invention is known and can be found in U.S. copending application Ser. No. 07/916,598 filed Jul. 20, 1992, now U.S. Pat. No. 5,306,126, assigned to the assignee of the present invention and hereby explicitly incorporated by reference.

The oil control mechanism comprises the use of the pressure differentials created at seal member 158 beneath orbiting scroll 50, in the oil pool 171, and on a top face surface 67 of the orbiting scroll plate 66. Stabilizer ring 100 of the present invention, by operation of radial passages 106, does not effect oil flowing past it. Ring 100 may actually help in pumping oil to the top of orbiting scroll member 50 as it orbits within main bearing 52 because oil may be "squeezed" between ring 100 and main bearing 52, causing oil to flow up to top face surface 67.

Compressor 10 includes an axial compliance mechanism characterized by three component forces, the first force being a constantly applied force dependent upon the magnitude of the pressures in discharge gases within housing 12 and suction pressure chamber 96, and the second force being primarily a reactionary force applied to the orbiting scroll member in response to rotating inclined and wobbling motion caused by overturning moments experienced by the orbiting scroll member due to forces imparted thereto by the drive mechanism and the third force being the constantly applied force dependent on wave washer spring 108 of the present invention.

With regard to the first constantly applied force of the axial compliance mechanism, respective fixed portions of back surface 65 are exposed to discharge and suction pressure, thereby providing a substantially constant force distribution acting upwardly upon orbiting scroll member 50 toward fixed scroll member 48. Consequently, moments about the central axis of orbiting scroll member 50 are minimized. More specifically, an annular seal mechanism 158, cooperating between back surface 65 and adjacent stationary thrust surface 55, sealingly separates between a radially inner portion and a radially outer portion of back surface 65, which are exposed to discharge pressure and suction pressure, respectively.

In a 40,000 BTU embodiment of the invention, for example, the outer diameter of thrust surface 55 is 3.48 in., the outer diameter of the flange portion of orbiting scroll 50 is 4.88 in., the average depth of oil pool 171 is 0.22 in., the oil viscosity is 100–300 SUS, and the overturning moment arm (½ the wrap height to the midpoint of bearing 86) is 1.172 in. The clearance of the outer edge of orbiting scroll member 50 to sidewall of the oil chamber is preferably in the range of 0.001 in. to 0.100 in., for example 0.025 in., in an exemplary embodiment. Depending on the design compression ratio, operating pressure conditions and scroll and seal geometry, these dimensions may change.

In operation of compressor 10, axial compliance of orbiting scroll member 50 toward fixed scroll member 48 occurs as the compressor compresses refrigerant fluid for discharge into housing 12. As housing 12 becomes pressurized, discharge pressure occupies the volume interior to seal element 158, thereby causing seal element 158 to expand radially outwardly and scroll member 50 to move axially upwardly away from thrust surface 55. As a result of the axial movement of scroll member 50, increased space is created between back surface 65 and thrust surface 55. Seal element 158 moves downwardly toward thrust surface 55 under the influence of gravity and/or a venturi effect created by the initial fluid flow between back surface 65 and thrust surface 55. From the foregoing, it will be appreciated that discharge pressure acting on seal element 158 creates a force distribution on the seal element that urges it axially downwardly toward thrust surface 55 and radially outwardly toward the outer wall of its seat to seal thereagainst.

The annular seal element disclosed herein is preferably composed of a Teflon material. More specifically, a glass-filled Teflon, or a mixture of Teflon, Carbon, and Ryton is preferred in order to provide the seal element with the necessary rigidity to resist extruding into clearances due to pressure differentials. The materials indicated above are only examples and any other conventional materials could be used. Furthermore, the surfaces against which the Teflon seal contacts could be cast iron or other conventional materials.

As previously described, the axial compliance mechanism in accordance with the present invention is characterized by a second reactionary force applied to the orbiting scroll member in response to rotating inclined and wobbling motion thereof. This is accomplished by providing an oil pool 171 adjacent the radially outer portion of back surface 65 of orbiting scroll member 50. Fixed scroll member 52 defines an annular oil chamber 178.

A tilting motion is caused by an overturning moment resulting from forces acting on the orbiting scroll 50 and fixed scroll 48. It should be noted that seal 158 is lifted slightly off thrust surface 55, thereby producing a widened gap that permits oil to be pumped radially outwardly into the wedge-shaped oil pool 171, thereby providing an increased force against the wobbling/tilting perturbations of orbiting scroll 50. As mentioned earlier, the rotating inclined motion of the orbiting scroll member will cause a rotating leak to occur between seal 158 and thrust surface 55, thereby pumping additional oil into the wedge-shaped oil pool 171.

Oil pool 171 is shown having sufficient depth in oil chamber 178 to fill the space between main bearing 52 and back surface 65. In this manner, rotating inclined wobbling motion of the orbiting scroll member results in an attempt to decrease the aforementioned space and thereby compress oil pool 171, which attempt is met by a reaction force exerted by the wedge-shaped oil pool on the back surface of the orbiting scroll member.

Oil is initially delivered to oil chamber 178 in order to establish oil pool 171, by development of a differential pressure across an initially under lubricated seal element 158. Oil that flows downwardly along the interface between roller 80 and sleeve bearing 86, and along the interface between bore 81 and crankpin, moves radially outwardly along the top surface of thrust plate 76 and is broadcast by interaction with rotating counterweight 77 (FIG. 1). This broadcasting action, along with the vacuuming effect of the orbiting scroll described in copending U.S. patent application Ser. No. 07/916,598, now U.S. Pat. No. 5,306,126 herein incorporated by reference, causes the oil to move upwardly along the annular space intermediate opening 79 and hub portion 84 and then radially outwardly to seal element 158. Initially, a relatively high rate of leakage past the seal element causes establishment of oil pool 171, which is maintained thereafter by minimal flow of oil past the seal element.

It will be appreciated that oil pool 171 is located within suction pressure chamber 98; however, the reaction force exerted by the oil pool on the orbiting scroll member in response to rotating inclined wobbling motion thereof is independent of ambient pressure level. Furthermore, application of the reactionary impulse force at a radially outermost portion of the orbiting scroll member results in the largest moment and, hence, the maximum benefit for resisting rotating inclined wobbling motion. Accordingly, the diameter of the back surface 65 must be sufficiently large to react with the oil pool 171 to dampen the inclined wobbling motion of orbiting scroll 50. At the same time, the first constantly applied axial compliance force need not be made excessively large in order to compensate for rotating inclined wobbling motion. Rather, the net force applied by the combination of discharge pressure and suction pressure on the back surface of the orbiting scroll member need only be great enough to resist the separating forces and moments produced in the compression pockets.

The axial compliance mechanism third component force of the constantly applied axial force dependent on wave washer spring 108 of stabilizer ring device 94 removes any wobbling motion not compensated for by oil pool 171 as described above. Depending upon the number of waves in wave washer spring 108, a like number of contact points are created where the small axial forces are located on the bottom of orbiting scroll member 50. Any small wobbling of orbiting scroll member 50 is compensated for by the reaction of wave washer spring 108 between scroll base plate 66, stabilizer ring 100, and thrust bearing 52. Application of this force from wave spring 108 creates an adaptive fit of the orbiting scroll member 50 to fixed scroll member 48 during compressor operation. By having a more closely fit scroll set, scroll wear-in time may be dramatically reduced.

In the disclosed embodiment, Oldham ring 88 and stabilizer ring are disposed within oil chamber 178, thereby interacting with oil pool 171 during orbiting motion of the orbiting scroll member 50. It is believed that the placement of Oldham ring 88 and stabilizer ring 100 within oil pool 171 and the agitation of the oil results in hydraulic forces being applied to back surface 65 of orbiting scroll member 50 that would not exist in its absence. Specifically, the Oldham ring and stabilizer ring 100 experience reciprocating motion relative back surface 65 and bottom surface with oil chamber 178 thereby causing localized hydraulic pressurization of the oil at the boundaries of the ring acting as a squeegee against the inertial forces of the oil. It is believed that this dynamic action causes an additional localized axial force on the orbiting scroll member to further enhance axial sealing.

It will be appreciated that the foregoing description of one embodiment of the invention is presented by way of illustration only and not by way of any limitation, and that various alternatives and modifications may be made to the illustrated embodiment without departing from the spirit and scope of the invention.

What is claimed is:

1. A hermetic scroll compressor comprising:

a hermetically sealed housing including therein a discharge chamber at discharge pressure and a suction chamber at suction pressure;

a fixed scroll member in said housing including an involute fixed wrap element;

an orbiting scroll member in said housing including a plate portion having a face surface and a back surface, said face surface having an involute orbiting wrap element thereon intermeshed with said fixed wrap element;

a frame including a thrust surface adjacent said orbiting scroll member back surface;

a seal between said orbiting scroll member and said thrust surface sealingly separating between respective portions of said plate portion back surface exposed to discharge pressure and suction pressure;

drive means for causing said orbiting scroll member to orbit relative to said fixed scroll member; and an annular stabilizer ring device nonsealingly disposed between said orbiting scroll member and said frame, said stabilizer ring device comprising a mechanical wave spring washer including a plurality of waves to contact said orbiting scroll member at a plurality of points to positively axially bias said orbiting scroll member toward said fixed scroll member, whereby wobbling of said orbiting scroll member is reduced.

2. The compressor of claim 1 in which said stabilizer ring device contacts said orbiting scroll member at a plurality of points whereby said orbiting scroll member is evenly axially forced toward said fixed scroll.

3. The compressor of claim 1 in which said stabilizer ring device is disposed within a shoulder on said back surface of said orbiting scroll member.

4. The compressor of claim 1 in which said stabilizer ring device includes at least one radial passage whereby oil is permitted to flow past.

5. The compressor of claim 1 in which said stabilizer ring device creates an axial force of approximately 60 pounds to 100 pounds against said orbiting scroll member.

6. The compressor of claim 1 in which said stabilizer ring device creates an axial force of approximately 80 pounds against said orbiting scroll member.

7. The compressor of claim 1 in which said stabilizer ring device includes a stabilizer ring located radially outside of said seal.

8. The compressor of claim 1 in which said suction chamber includes sidewalls, said drive means causing said stabilizer ring device to move toward and away from said suction chamber sidewalls during compressor operation, whereby oil movement within said compressor is assisted by said stabilizer ring movement.

9. The compressor of claim 1 in which said stabilizer ring device further comprises a stabilizer ring disposed between said frame and said orbiting scroll member, said stabilizer ring engaging said wave spring washer whereby said stabilizer ring limits the amount of deformation of said wave spring washer.

10. The compressor of claim 9 in which said wave spring washer is located between and engages said orbiting scroll member and said stabilizer ring.

11. The compressor of claim 10 in which said stabilizer ring device includes at least one radial passage whereby oil id permitted to flow past.

12. The compressor of claim 11 in which said stabilizer ring device includes said stabilizer ring located radially outside of said seal.

13. The compressor of claim 1 in which said mechanical spring contacts said orbiting scroll member at a plurality of points whereby said orbiting scroll member is evenly axially forced toward said fixed scroll.

14. The compressor of claim 13 in which said stabilizer ring device further comprises a stabilizer ring disposed between said frame and said orbiting scroll member, said stabilizer ring engaging said mechanical spring whereby said stabilizer ring limits the amount of deformation of said mechanical spring.

15. The compressor of claim 14 in which said mechanical spring is located between and engages said orbiting scroll member and said stabilizer ring.

16. The compressor of claim 15 in which said stabilizer ring device includes at least one radial passage whereby oil is permitted to flow past.

17. The compressor of claim 1 in which said stabilizer ring device further comprises a stabilizer ring disposed between said frame and said orbiting scroll member, said stabilizer ring engaging said mechanical spring whereby said stabilizer ring limits the amount of deformation of said mechanical spring.

18. The compressor of claim 17 in which said mechanical spring is located between and engages said orbiting scroll member and said stabilizer ring.

19. The compressor of claim 18 in which said stabilizer ring device includes at least one radial passage whereby oil is permitted to flow past.

20. A hermetic scroll compressor comprising:

a hermetically sealed housing including therein a discharge chamber at discharge pressure and a suction chamber at suction pressure;

a fixed scroll member in said housing including an involute fixed wrap element;

an orbiting scroll member in said housing including a plate portion having a face surface and a back surface, said face surface having an involute orbiting wrap element thereon intermeshed with said fixed wrap element, said orbiting scroll member plate portion having a flange extending radially beyond said orbiting wrap element, said flange including an upper peripheral edge and a shoulder on said back surface;

a frame including a thrust surface adjacent said orbiting scroll member back surface;

a seal between said orbiting scroll member and said thrust surface sealingly separating between respective portions of said plate portion back surface exposed to discharge pressure and suction pressure;

drive means for causing said orbiting scroll member to orbit relative to said fixed scroll member;

means defining an oil chamber in which said orbiting scroll member flange orbits, said oil chamber at suction pressure;

a stabilizer ring device non-sealingly disposed between said orbiting scroll member and said frame, said stabilizer ring device mechanically axially biasing said orbiting scroll member toward said fixed scroll member, said stabilizer ring device is disposed within said shoulder; and an oil pool of sufficient depth in said oil chamber to extend said oil pool above said upper peripheral edge of said orbiting scroll member as said orbiting scroll orbits, whereby the oil pool and said stabilizer ring device reduce orbiting scroll wobble.

21. The compressor of claim 20 in which said stabilizer ring device is located radially outside of said seal.

22. The compressor of claim 20 in which said stabilizer ring device creates an axial force of approximately 60 pounds to 100 pounds against said orbiting scroll member.

23. The compressor of claim 20 in which said stabilizer ring device creates an axial force of approximately 80 pounds against said orbiting scroll member.

24. The compressor of claim 20 in which said stabilizer ring device includes a wave spring washer to provide the axial biasing force to said orbiting scroll member.

25. The compressor of claim 20 in which said suction chamber includes sidewalls, said drive means causing said stabilizer ring device to move toward and away from said suction chamber sidewalls during compressor operation, whereby oil movement within said compressor is assisted by said stabilizer ring device movement.

26. The compressor of claim 20 in which said stabilizer ring device comprises a mechanical spring to provide the axial biasing force to said orbiting scroll member.

27. The compressor of claim 20 in which said stabilizer ring device comprises a wave spring washer to provide the axial biasing force to said orbiting scroll member.

28. The compressor of claim 20 in which said stabilizer ring device contacts said orbiting scroll member at a plurality of points whereby said orbiting scroll member is evenly axially forced toward said fixed scroll.

29. A hermetic scroll compressor comprising:

a hermetically sealed housing including therein a discharge chamber at discharge pressure and a suction chamber at suction pressure;

a fixed scroll member in said housing including an involute fixed wrap element and a discharge port;

an orbiting scroll member in said housing including a plate portion having a face surface and a back surface, said face surface having an involute orbiting wrap element thereon intermeshed with said fixed wrap element;

a frame including a thrust surface adjacent said orbiting scroll member back surface;

a seal between said orbiting scroll member and said thrust surface sealingly separating between respective portions of said plate portion back surface exposed to discharge pressure and suction pressure;

drive means for causing said orbiting scroll member to orbit relative to said fixed scroll member; and a wave spring washer nonsealingly disposed between said orbiting scroll member and said frame, said wave spring washer biasing said orbiting scroll member toward said fixed scroll member, whereby said wave spring washer permits the compressor housing to quickly equalize compressor thereby reducing shutdown noise.

30. The compressor of claim 29 further including an absence of a check valve from said discharge port whereby reverse rotation of said orbiting scroll at compressor shutdown is prevented.

* * * * *